US009630814B2

(12) United States Patent
Southerland, Jr.

(10) Patent No.: US 9,630,814 B2
(45) Date of Patent: Apr. 25, 2017

(54) SYSTEM AND APPARATUS FOR MOTION COMPENSATION AND ANTI-PENDULATION

(71) Applicant: Arthur Southerland, Jr., Washington, DC (US)

(72) Inventor: Arthur Southerland, Jr., Washington, DC (US)

( * ) Notice: Subject to any disclaimer, the term of this patent is extended or adjusted under 35 U.S.C. 154(b) by 0 days.

(21) Appl. No.: 15/209,694

(22) Filed: Jul. 13, 2016

(65) Prior Publication Data

US 2017/0015530 A1 Jan. 19, 2017

Related U.S. Application Data

(60) Provisional application No. 62/192,224, filed on Jul. 14, 2015.

(51) Int. Cl.

| | |
|---|---|
| ***B68C 1/10*** | (2006.01) |
| ***B66C 13/06*** | (2006.01) |
| ***B66C 1/10*** | (2006.01) |
| *B63B 27/30* | (2006.01) |
| *B63B 27/10* | (2006.01) |

(52) U.S. Cl.

CPC ..... *B66C 13/06* (2013.01); *B66C 1/101* (2013.01); *B63B 27/10* (2013.01); *B63B 27/30* (2013.01)

(58) Field of Classification Search

CPC .. B66C 1/10; B66C 1/22; B66C 1/223; B66C 1/66; B66C 1/663; B66C 13/06; B66C 13/10

See application file for complete search history.

(56) References Cited

U.S. PATENT DOCUMENTS

| | | | | |
|---|---|---|---|---|
| 4,003,472 | A | 1/1977 | Reynolds et al. | |
| 4,025,055 | A * | 5/1977 | Strolenberg | B66D 1/52 212/308 |
| 4,268,013 | A * | 5/1981 | Khan | B66C 13/02 175/27 |
| 5,052,734 | A * | 10/1991 | Hasegawa | B66C 1/663 294/81.2 |
| 6,082,947 | A * | 7/2000 | Adamson | B63B 27/10 212/308 |
| 6,826,452 | B1 * | 11/2004 | Holland | B66C 1/663 318/566 |
| 7,534,082 | B2 | 5/2009 | Rawdon et al. | |
| 2002/0129755 | A1 * | 9/2002 | Hagen | B66C 13/02 114/268 |
| 2005/0179021 | A1 * | 8/2005 | Selcer | B66D 1/52 254/275 |
| 2014/0305361 | A1 * | 10/2014 | Eilertsen | B63B 21/16 114/230.23 |
| 2015/0266704 | A1 * | 9/2015 | Jewell | B66C 13/18 414/803 |

* cited by examiner

*Primary Examiner* — Emmanuel M Marcelo
(74) *Attorney, Agent, or Firm* — The Law Firm of Andrea Hence Evans, LLC

(57) ABSTRACT

A system and assembly for providing anti-sway and motion compensation while handling ISO containers in high sea states up to and above sea state four between a lighter or other floating body and a crane ship. The contemplated invention enables the transfer of cargo containers between a container ship and a lighter or other floating body at sea in sea states up to and higher than sea state four by synchronizing the motion of the container and the lighter or floating body.

23 Claims, 4 Drawing Sheets

SYSTEM AND APPARATUS FOR MOTION COMPENSATION AND ANTI-PENDULATION

CROSS-REFERENCE TO RELATED APPLICATIONS

This application claims the benefit of, and is related to, the following Applicant's provisional patent application: U.S. Provisional Patent Application No. 62/192,224 titled "SHIPBOARD CRANE CONTAINER HANDLING SPREADER MOTION COMPENSATION ANTI-PENDULATION" filed Jul. 14, 2015, which is incorporated herein in its entirety.

FIELD OF THE INVENTION

The present invention relates, in general, to a shipboard crane container handling spreader structurally and functionally designed to transfer cargo containers while at sea.

BACKGROUND OF THE INVENTION

The shipboard crane container handling spreader is designed to provide a capability to transfer cargo containers from a container ship to a lighter or other floating body at sea in high sea states up to and above sea state four. Some prior art have employed electronic synchronization in an attempt to determine the six degrees of motion associated with payload and floating platforms. Others have used sophisticated numerical simulation small-scale models and distance & inertial sensors to track payload relative motion and pendulation.

SUMMARY OF THE INVENTION

The present invention has been in response to the lack of a capability to transfer cargo containers between a container ship and a lighter or other floating body at sea. The US Navy relies on commercial cargo vessels to transport supplies around the world. These cargo ships require commercial harbors with specialized cranes to off-load the containers. However in many cases cargo is required to be delivered to sites which do not have suitable off-load facilities. The container ship will have to anchor off-shore where cargo is off-loaded to a lighter or other floating body moored to the container ship.

Aspects of embodiments of the present invention contemplate a system for motion compensation anti-pendulation which may include a crane having an electric cable signal cable reel, a rope rigging system, which may include rigging wire or rope connected to the crane at a lift point, a spreader assembly, connected to the crane via the rope rigging system and used to connect with a container where the spreader assembly may include: anti-sway winch(es) having anti-sway lines or rope, a hydraulic power unit, variable pressure accumulator(s) connected to the hydraulic power unit, ram tensioner(s) and a hydraulic piping system connecting the variable pressure accumulator(s), ram tensioner(s) and the hydraulic power unit.

In an aspect of an embodiment of the present invention, the spreader assembly may further include rope chocks for guiding the anti-sway rope to deck fittings of a lighter or floating body container landing spot.

In an aspect of an embodiment of the present invention, the ram tensioner(s) may include three ram tensioner sheaves and two fair lead sheaves for each ram tensioner.

In an aspect of an embodiment of the present invention, there may be two ram tensioner sheaves at the top of each ram tensioner(s) and one turnaround ram tensioner sheave at the bottom of each ram tensioner(s).

Aspects of embodiments of the present invention contemplate system(s), structure(s), apparatus(es) and/or means to provide for anti-sway and motion compensation to handle ISO containers in high sea states up to and above sea state four.

An aspect of an embodiment of the present invention contemplates system(s) and/or structure(s) which may include wire rope rigging, fair lead and ram tensioners sheaves all utilized and configured to facilitate vertical motion control and to compensate for high sea states i.e. sea states up to and above sea state four and prevent deck impact of the container with the lighter deck or other floating bodies.

Another aspect of an embodiment of the present invention contemplates apparatus(es), assembly(ies), system(s) for motion compensation anti-pendulation which may include a crane boom having an electric cable reel and a container spreader connected to the crane boom by way of a control cable of the cable reel, where the spreader may include anti-sway winch(es) and wire rope chock(s) for guiding anti-sway lines or rope to the deck fittings of a lighter or a floating body.

In another aspect of an embodiment of the present invention, the spreader may be structurally configured and/or structurally enabled to facilitate soft landing of a container onto or within a landing spot of the deck of the lighter or floating body. The landing spot is the location on the lighter (or other floating body) where the container or load is to be placed.

In another aspect of an embodiment of the present invention, the spreader may further include a system of wire rope rigging which may include ram tensioner(s) having ram tensioner sheave(s) and fair lead sheave(s) leading to the crane lift point.

In another aspect of an embodiment of the present invention, the end point of the rigging may be anchored to the base of the ram tensioner(s).

In another aspect of an embodiment of the present invention, the rigging wire rope may pass over the ram tensioner sheave(s) to a turnaround sheave at the base of ram tensioner(s).

In another aspect of an embodiment of the present invention, the rigging wire rope may pass over two fair lead sheaves and on to the crane lift point.

In another aspect of an embodiment of the present invention, the spreader may further include hydraulic components where the hydraulic components may include a hydraulic power unit which receives electric power and control signals from the power and control cable on the crane boom and two variable pressure accumulators.

In an aspect of an embodiment of the present invention, the hydraulic power unit may include a variable displacement pump configured to change the volume of hydraulic oil within the variable pressure accumulator(s) in order to: enable accommodation of different containers with different weights and to provide tension within the anti-sway lines, by way of the anti-sway winches, to prevent payload pendulation while being handled by the shipboard crane between the ship and lighter or other floating body.

In another aspect of an embodiment of the present invention, one variable pressure accumulator may serve the ram tensioner(s) while another variable pressure accumulator may serve the anti-sway (anti-pendulation) winch(es).

In one aspect of an embodiment of the present invention, the variable pressure accumulator(s) may be provided to change the pressure in the ram tensioner(s) to accommodate containers with different weights and to facilitate motion compensation when the container is landing on the lighter deck or other floating body.

In another aspect of an embodiment of the present invention, the spreader may further include hydraulic controlled bayonet cone container lock/unlock device(s) and flipper guide(s).

A further aspect of an embodiment of the present invention contemplates a spreader assembly for motion compensation and anti-pendulation which may include: anti-sway winch(es) mounted thereon where the anti-sway winch(es) may each have anti-sway lines or rope, a hydraulic power unit, positioned and mounted on the spreader assembly, ram tensioner(s) connected to the hydraulic power unit and also mounted on the spreader assembly, variable pressure accumulator(s), where the variable pressure accumulator(s) is connected to the ram tensioner(s) and the hydraulic power unit and where the variable pressure accumulator(s) is mounted on the spreader assembly, and a hydraulic piping system connecting the variable pressure accumulator(s), the ram tensioner(s) and the hydraulic power unit.

In a further aspect of an embodiment of the present invention, the spreader assembly may further include rope chocks for guiding the anti-sway rope to deck fittings of a lighter or floating body container landing spot.

In a further aspect of an embodiment of the present invention, each of the ram tensioner(s) may include three ram tensioner sheaves for each ram tensioner(s) and two fair lead sheaves for each ram tensioner(s).

In a further aspect of an embodiment of the present invention, there may be two ram tensioner sheaves at the top of the ram tensioner(s) and one turnaround ram tensioner sheave at the bottom of the ram tensioner(s).

In a further aspect of an embodiment of the present invention, the spreader assembly may be operationally connected to a crane via a rope rigging system having rigging wire or rope and where the spreader assembly and the crane are both used to lower or lift a container.

In a further aspect of an embodiment of the present invention, the spreader assembly may be structurally configured to enable an end point of the rigging wire or rope to be anchored to the base of the ram tensioner(s).

In a further aspect of an embodiment of the present invention, the spreader assembly may be configured to enable the rigging wire rope to pass over ram tensioner(s) sheave to a turnaround sheave at the bottom of the ram tensioner(s).

In a further aspect of an embodiment of the present invention, the spreader assembly may be structurally configured to enable the rigging wire rope to pass over two fair lead sheaves and on to the lift point.

In a further aspect of an embodiment of the present invention, the variable pressure accumulator(s) may be configured to change pressure in the ram tensioner(s) in order to accommodate different containers with different weights and to facilitate motion compensation when the container is landing on a lighter deck or other floating body.

In a further aspect of an embodiment of the present invention, the hydraulic power unit may include a variable displacement pump configured to change volume of hydraulic oil within the variable pressure accumulator(s) in order to: enable accommodation of different containers with different weights and to provide tension within the anti-sway lines, by way of the anti-sway winches, to prevent payload pendulation while being handled by the shipboard crane between the ship and lighter or other floating body.

In a further aspect of an embodiment of the present invention, a first variable pressure accumulator of the variable pressure accumulator(s) may serve the ram tensioner(s) while a second variable pressure accumulator of the variable pressure accumulator(s) may serve the anti-sway winches.

In a further aspect of an embodiment of the present invention, the spreader assembly may further include lock/unlock device(s) and flipper guide(s) for securing the spreader assembly to the container.

The structural configurations of the spreader assembly discussed above may be made possible by the strategic positioning of the spreader assembly's components or elements to enable the connections or configurations discussed herein.

DETAILED DESCRIPTION OF THE INVENTION

Figure 1:
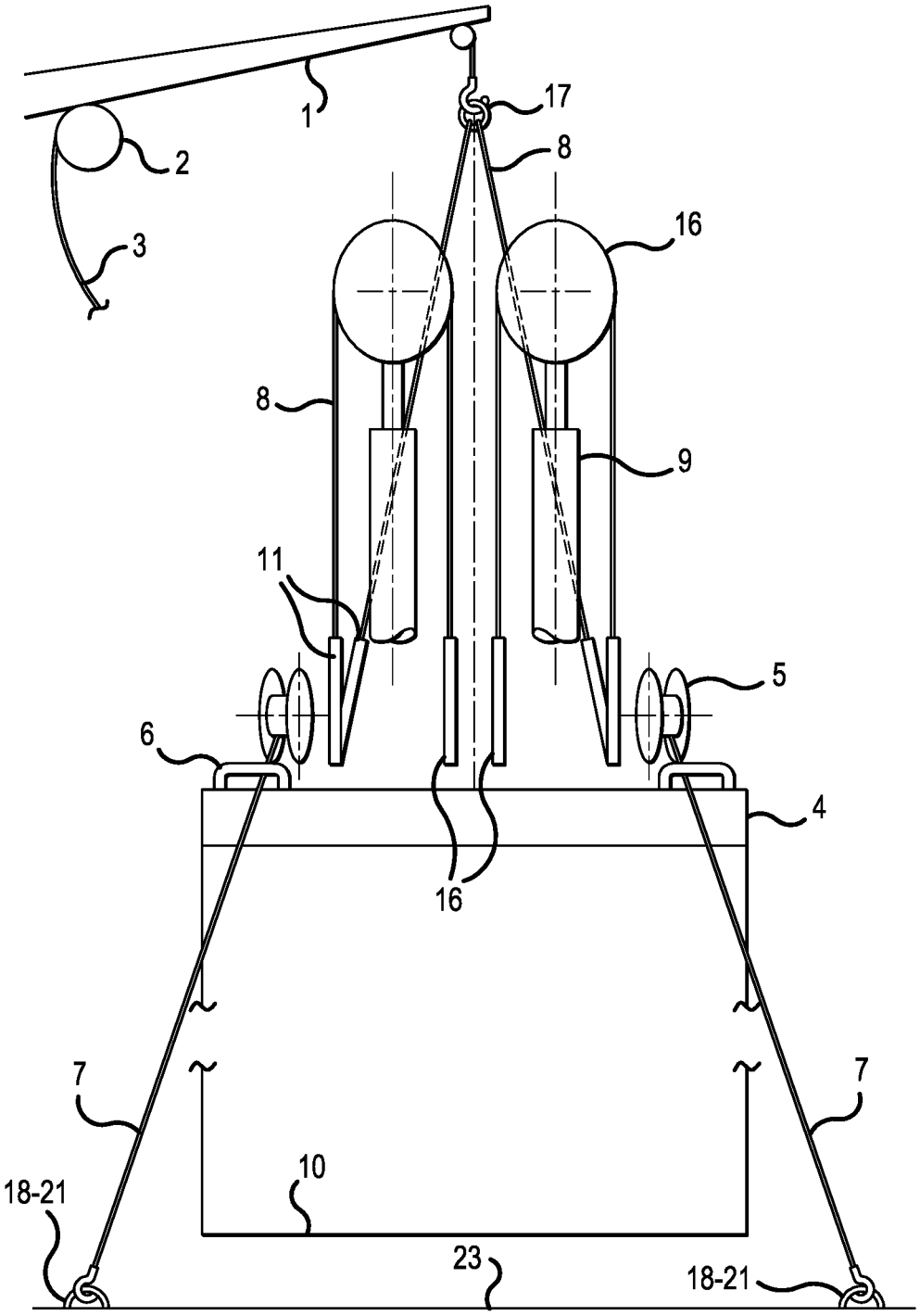
FIG. 1 illustrates a crane handling a spreader assembly and container landing on a deck of a lighter or other floating body according to an aspect of an embodiment of the present invention.

Referring now to FIGS. 1 through 4, aspects of embodiments of a motion compensation anti-pendulation system are shown. The motion compensation anti-pendulation system may include a shipboard crane 1 having an electric and cable reel 2 which may be connected to a control cable 3 that is further attached to hydraulic power unit 12 mounted on an ISO cargo container spreader assembly 4. Crane 1 may be used to transfer container 10 from the crane ship to a container landing zone 22 of a lighter or other floating body in high sea states up to and including 4 or higher. Anti-sway winches 5 and wire rope chocks 6 may also be provided on spreader assembly 4 to guide the anti-sway wire rope 7 to the deck securing fitting fittings 18-21—which are on the landing deck 23 or container landing zones 22 of the lighter or other floating body. The above fittings together with motion compensation components mounted on the spreader assembly 4 are provided to facilitate a soft landing of container 10 onto the deck of the lighter or other floating body or container landing zone.

After the deck crew on the crane ship passes the anti-sway control lines 7 to the deck crew on the lighter or other floating body for securing to the deck securing fittings 18-21, the transfer operation continues (FIG. 1). During the lowering operation, back tension is applied to lift point 17 so that the anti-sway control lines 7 will develop enough tension to control anti-pendulation during the lowering operation. Tension is realized by controlling the lowering speed of crane 1 and also controlling the speed of anti-sway winches 5 so that winches 5 are pulling container 10 down to lighter deck 23. As the pay load or container 10 approaches landing spot 22 of the lighter or other floating body, tension is increased until motion compensation is initiated in the ram tensioners 9. This is due to the wave motion on the lighter or other floating body which will cause the motions of the pay load and lighter or other flotation body to synchronize with each other to assure a soft landing of the pay load 10 on landing spot 22 of landing deck of lighter 23.

Figure 2:
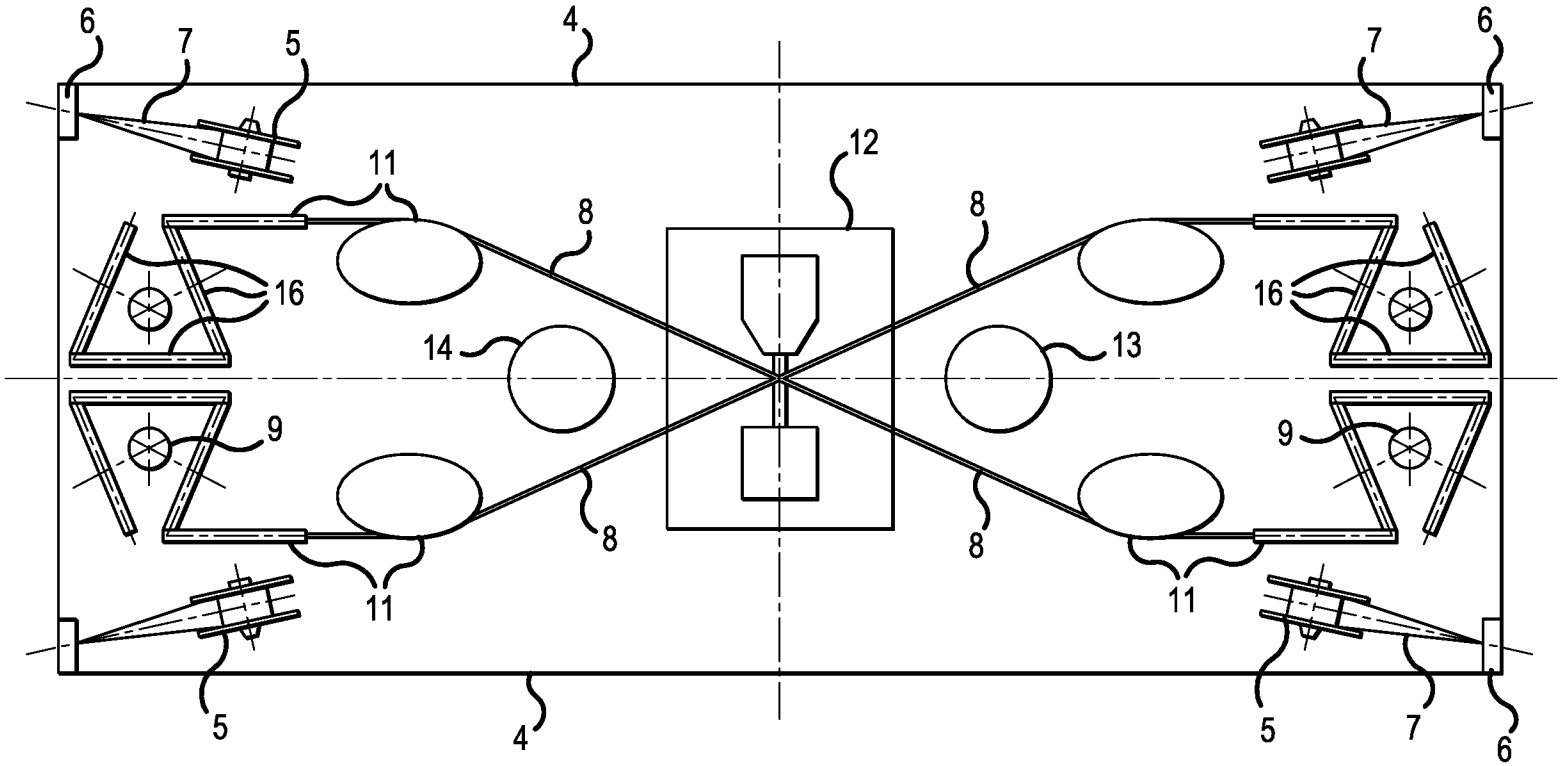
FIG. 2 illustrates a plan view of a spreader assembly and motion compensation components mounted on the spreader assembly according to an aspect of an embodiment of the present invention.
Figure 3:
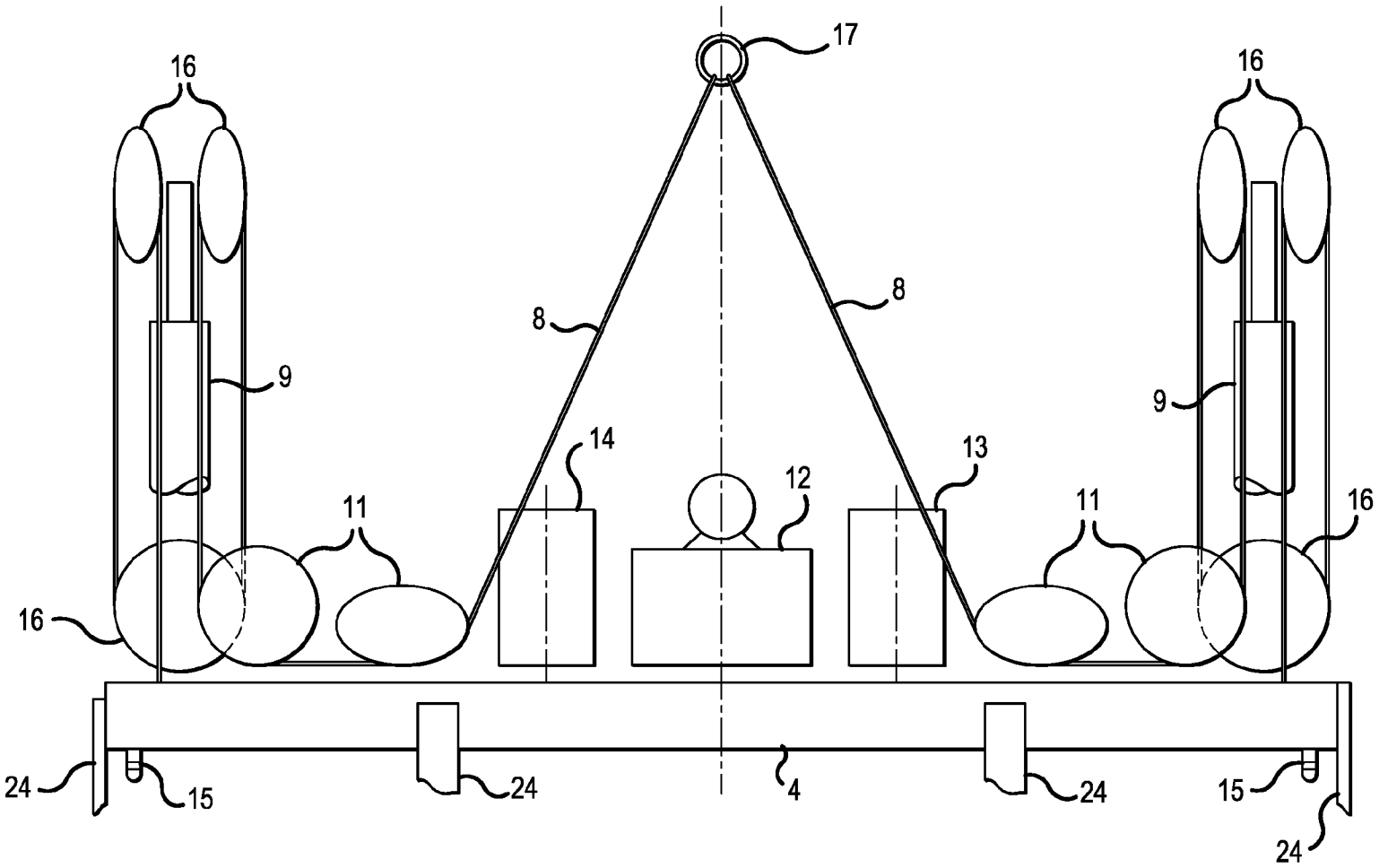
FIG. 3 illustrates an elevation view of a spreader assembly to indicate the relative location of the components on the spreader assembly according to an aspect of an embodiment of the present invention.
Figure 4:
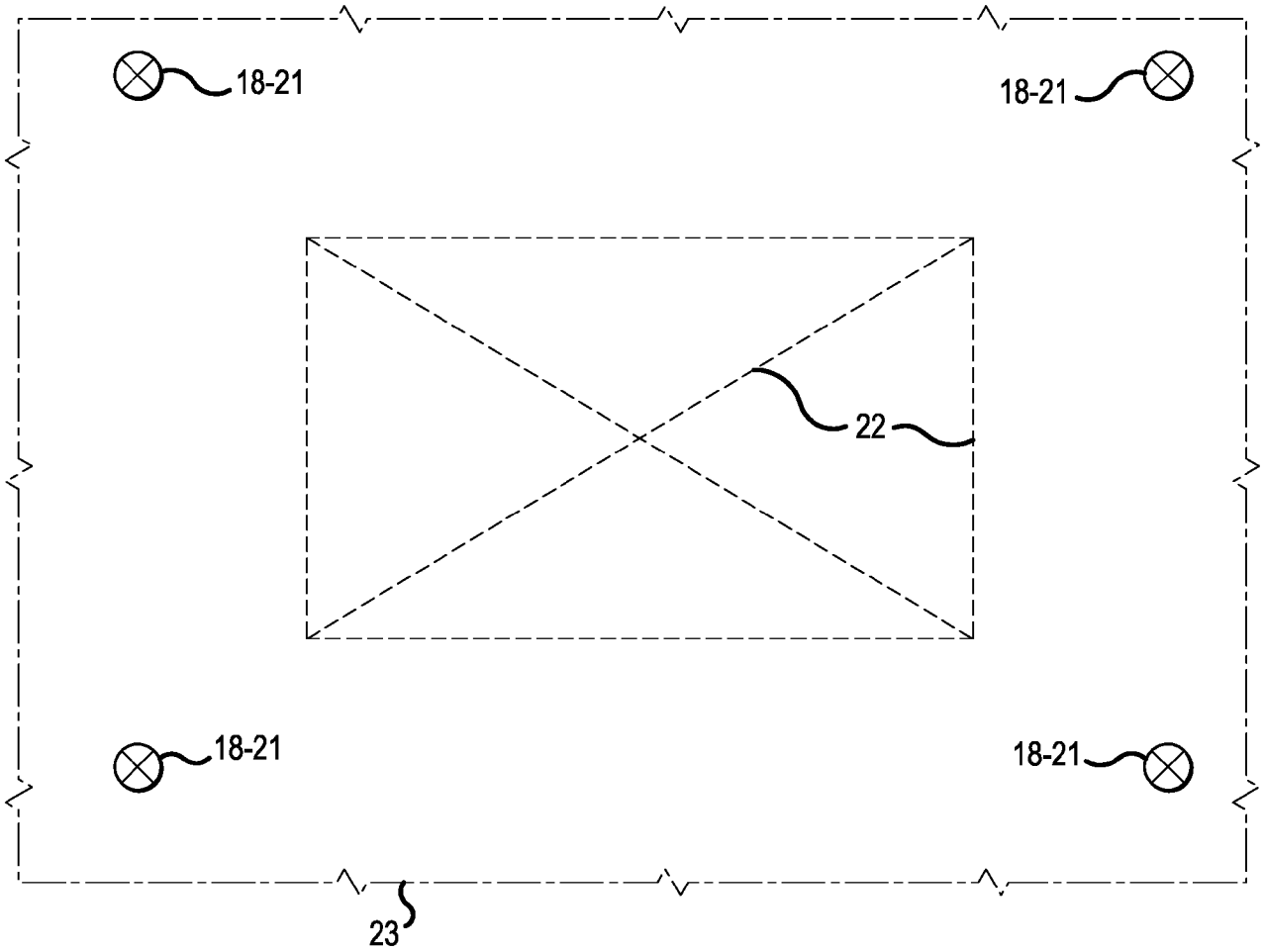
FIG. 4 illustrates a container landing spot on the lighter or other floating body.

Referring specifically now to FIGS. 2 through 4 a plan view of spreader assembly 4, an elevation view of spreader assembly 4 indicating the relative location of the different components on the spreader assembly 4, and a plan view showing landing spot 22 of lighter deck or floating body 23 are all illustrated according to aspects of embodiments of the present invention. Spreader assembly 4 is shown having wire rope rigging 8 arrangement of four ram tensioners 9 with three ram tensioner sheaves 16 and two fair lead sheaves 11 leading to the crane lift point 17. The end point of wire rope rigging element 8, in one aspect of an embodiment of the present invention, may start at or be anchored to the base of ram tensioner 9 and pass over the top of ram tensioner sheave 16 and leading on to turnaround sheave 16 at the bottom of ram tensioner 9. Wire rope rigging element 8 may, in an aspect of an embodiment of the present invention, further extend on to two fair head sheaves 11 and on to crane lift point 17. The hydraulic components mounted on the spreader assembly 4 may include a hydraulic power unit 12 which receives electric power and control signals from the power and control cable 3 on the crane boom 1. The hydraulic components mounted on the assembly 4 may include a hydraulic power unit 12 and two variable pressure accumulators 13 and 14. In an aspect of an embodiment of the present invention, variable pressure accumulators 13 and 14 operate by first hydraulic oil contained within them using nitrogen gas bottles in a fixed volume. Next, hydraulic power unit 12, which has a variable displacement pump, is utilized to change the volume of the oil which in turn changes the pressure in variable pressure accumulators 13 and 14. This will also change the pressure in the variable pressure accumulators to suit the change in weight of various containers. Further, this allows for the increase in the tension of the anti-sway control lines or ropes 7 to facilitate motion compensation from wave action on the lighter and cause the motion of container 10 and the lighter to synchronize. Variable pressure accumulators 13 and 14 are connected to ram tensioners 9 and anti-sway winches 5 by a hydraulic piping system (not shown).

In an aspect of an embodiment of the present invention, one variable pressure accumulator may serve the ram tensioners 9 while another variable pressure accumulator may serve the anti-pendulation winches 5. Spreader assembly 4 may also be fitted with hydraulic controlled bayonet cone container lock/unlock devices 15 and flipper guides 24 which all may be used to secure spreader assembly 4 to container 10. As discussed above, variable pressure accumulators 13 and 14 are provided, in an aspect of an embodiment of the present invention, to change the pressure in the ram tensioners 9 to accommodate containers with different weights and to facilitate motion compensation when container 10 is landing on the lighter's deck or other floating body container's landing spot 22.

In an aspect of an embodiment of the present invention, operation of system may begin with an operator using shipboard crane 1 pickup spreader assembly 4 from its stowage position. Crane 1 with spreader assembly 4 attached, will then be used to pick up container 10 by aligning, engaging and locking devices. Crane 1 will then position container 10 over the lighter at the side of the ship and the ship deck crew will pass anti-sway lines or ropes 7 to the lighter's deck crew for connecting to securing fittings 18-21 on the lighter.

In an aspect of an embodiment of the present invention, the lowering operation may be initiated with crane 1 lowering spreader assembly 4 which is engaged with container 10 and anti-sway winch(es) 5 pulling container 10 down to the lighter. This assures anti-pendulation and the increase in tension will cause the motion of container 10 and the lighter to synchronize for a soft landing of container 10 onto landing deck 23 of the lighter within the desired landing spot 22. After container 10 has been secured within landing spot 22, anti-sway lines or ropes 7 are then disconnected and retracted and the operation can be repeated for additional loads or containers.

The invention has been described in detail with particular reference to certain preferred embodiments thereof, but it will be understood that variations and modifications can be effected within the spirit and scope of the invention.

What is claimed is:

1. A system for motion compensation and anti-pendulation comprising:

a crane having an electric cable signal cable reel;

a rope rigging system, comprising of rigging wire or rope connected to the crane at a lift point;

a spreader assembly, connected to the crane via the rope rigging system and used to connect with a container wherein the spreader assembly comprises of: at least one anti-sway winch having anti-sway lines, a hydraulic power unit, at least one variable pressure accumulator connected to the hydraulic power unit and at least one ram tensioner and a hydraulic piping system connecting the at least one variable pressure accumulator, at least one ram tensioner and the hydraulic power unit.

2. The system of claim 1 wherein the spreader assembly further comprises of rope chocks for guiding the anti-sway rope to deck fittings of a lighter or floating body container landing spot.

3. The system of claim 1 wherein each at least one ram tensioner comprises of three ram tensioner sheaves for each at least one ram tensioner and two fair lead sheaves for each at least one ram tensioner.

4. The system of claim 1 wherein an end point of the rope rigging system may be anchored to a base of the at least one ram tensioner.

5. The system of claim 4 wherein there are two ram tensioner sheaves at the top of the at least one ram tensioner and one turnaround ram tensioner sheave at the bottom of the at least one ram tensioner.

6. The system of claim 4 wherein the rigging wire or rope passes over at least one ram tensioner sheave to a turnaround sheave at the bottom of the at least one ram tensioner.

7. The system of claim 4 wherein the rigging wire or rope passes over two fair lead sheaves and on to the lift point.

8. The system of claim 1 wherein the at least one variable pressure accumulator is configured to change pressure in the at least one ram tensioner in order to accommodate different containers with different weights and to facilitate motion compensation when the container is landing on a lighter deck or other floating body.

9. The system of claim 8 wherein the hydraulic power unit comprises of a variable displacement pump configured to change volume of hydraulic oil within the at least one variable pressure accumulator in order to: enable accommodation of different containers with different weights and to provide tension within the anti-sway lines, by way of the anti-sway winches, to prevent payload pendulation while being handled by the shipboard crane between the ship and lighter or other floating body.

10. The system of claim 9 wherein a first variable pressure accumulator of the at least one variable pressure accumulator serves the at least one ram tensioner while a second variable pressure accumulator of the at least one variable pressure accumulator serves the anti-sway winches.

11. The system of claim 1 wherein the spreader assembly further comprises of lock/unlock device(s) and flipper guide(s) for securing the spreader assembly to the container.

12. A spreader assembly for motion compensation and anti-pendulation comprising:

at least one anti-sway winch mounted thereon wherein the at least one anti-sway winch comprises of anti-sway lines or rope;

a hydraulic power unit, positioned and mounted on the spreader assembly;

at least one ram tensioner connected to the hydraulic power unit and also mounted on the spreader assembly;

at least one variable pressure accumulator, wherein the at least one variable pressure accumulator is connected to the at least one ram tensioner and the hydraulic power unit and wherein the at least one variable pressure accumulator is mounted on the spreader assembly; and a hydraulic piping system connecting the at least one variable pressure accumulator, the at least one ram tensioner and the hydraulic power unit.

13. The spreader assembly of claim 12 wherein the spreader assembly further comprises of rope chocks for guiding the anti-sway rope to deck fittings of a lighter or floating body container landing spot.

14. The spreader assembly of claim 12 wherein each of said at least one ram tensioner comprises of three ram tensioner sheaves for each said at least one ram tensioner and two fair lead sheaves for each said at least one ram tensioner.

15. The spreader assembly of claim 14 wherein there are two ram tensioner sheaves at a top of the at least one ram tensioner and one turnaround ram tensioner sheave at a bottom of the at least one ram tensioner.

16. The spreader assembly of claim 12, wherein the spreader assembly is operationally connected to a crane via a rope rigging system having rigging wire or rope and wherein the spreader assembly and the crane are both used to lower or lift a container.

17. The spreader assembly of claim 16 wherein the spreader assembly is structurally configured to enable an end point of the rigging wire or rope to be anchored to a base of the at least one ram tensioner.

18. The spreader assembly of claim 16 wherein the spreader assembly is structurally configured to enable the rigging wire rope to pass over at least one ram tensioner sheave to a turnaround sheave at a bottom of the at least one ram tensioner.

19. The spreader assembly of claim 16 wherein the spreader assembly is structurally configured to enable the rigging wire rope to pass over two fair lead sheaves and on to a lift point.

20. The spreader assembly of claim 16 wherein the at least one variable pressure accumulator is configured to change pressure in the at least one ram tensioner in order to accommodate different containers with different weights and to facilitate motion compensation when the container is landing on a lighter deck or other floating body.

21. The spreader assembly of claim 20 wherein the hydraulic power unit comprises of a variable displacement pump configured to change volume of hydraulic oil within the at least one variable pressure accumulator in order to: enable accommodation of different containers with different weights and to provide tension within the anti-sway lines, by way of the at least one anti-sway winch, to prevent payload pendulation while being handled by a shipboard crane between a ship and a lighter or other floating body.

22. The spreader assembly of claim 12 wherein a first variable pressure accumulator of the at least one variable pressure accumulator serves the at least one ram tensioner while a second variable pressure accumulator of the at least one variable pressure accumulator serves the anti-sway winches.

23. The spreader assembly of claim 16 wherein the spreader assembly further comprises of lock/unlock device(s) and flipper guide(s) for securing the spreader assembly to the container.

* * * * *